US008870481B2

(12) United States Patent
Kosuge

(10) Patent No.: US 8,870,481 B2
(45) Date of Patent: Oct. 28, 2014

(54) TAPE CUTTING APPARATUS, TAPE PRINTING APPARATUS HAVING THE SAME, AND METHOD OF CONTROLLING STEPPING MOTOR

(75) Inventor: Shinsaku Kosuge, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 175 days.

(21) Appl. No.: 13/480,055

(22) Filed: May 24, 2012

(65) Prior Publication Data

US 2012/0308289 A1 Dec. 6, 2012

(30) Foreign Application Priority Data

May 31, 2011 (JP) ..... 2011-121443
Jun. 3, 2011 (JP) ..... 2011-125427
Jun. 8, 2011 (JP) ..... 2011-128044

(51) Int. Cl.
*B41J 11/66* (2006.01)
*B41J 11/00* (2006.01)
*B41J 11/70* (2006.01)

(52) U.S. Cl.
CPC ..... *B41J 11/666* (2013.01); *B41J 11/009* (2013.01); *B41J 11/703* (2013.01)
USPC ..... 400/621

(58) Field of Classification Search
CPC ..... B41J 11/70; B41J 11/66
USPC ..... 400/621
See application file for complete search history.

(56) References Cited

U.S. PATENT DOCUMENTS

| | | | | | |
|---|---|---|---|---|---|
| 5,315,398 | A * | 5/1994 | Otsuki | ..... | 358/304 |
| 5,957,597 | A | 9/1999 | Kato | | |
| 2011/0052301 | A1* | 3/2011 | Crystal et al. | ..... | 400/621 |
| 2011/0280644 | A1* | 11/2011 | Toyoshima | ..... | 400/621 |

FOREIGN PATENT DOCUMENTS

| | | | | | |
|---|---|---|---|---|---|
| JP | 03003797 | A * | 1/1991 | | |
| JP | 06286241 | A * | 10/1994 | ..... | B41J 11/66 |
| JP | 09011192 | A * | 1/1997 | ..... | B26D 5/08 |
| JP | 11010592 | A * | 1/1999 | ..... | B41J 11/66 |
| JP | 2002-103279 | A | 4/2002 | | |
| JP | 2002-254393 | A | 9/2002 | | |
| JP | 2006168094 | A * | 6/2006 | ..... | B41J 11/70 |
| JP | 2006297598 | A * | 11/2006 | | |
| JP | 3861558 | B | 12/2006 | | |
| JP | 4224719 | B | 2/2009 | | |
| JP | 4337937 | B | 9/2009 | | |
| JP | 4539620 | B | 9/2010 | | |

* cited by examiner

*Primary Examiner* — Nguyen Ha
(74) *Attorney, Agent, or Firm* — ALG Intellectual Property, LLC

(57) ABSTRACT

A tape cutting apparatus including: a half cutter configured to cut a body tape or a release tape with respect to a processed tape having the release tape adhered to the body tape; a stepping motor configured to cause the half cutter to perform a cutting operation; and a motor control unit configured to control the stepping motor, wherein the motor control unit is configured to continue the cutting operation until the stepping motor loses steps.

14 Claims, 11 Drawing Sheets

TAPE CUTTING APPARATUS, TAPE PRINTING APPARATUS HAVING THE SAME, AND METHOD OF CONTROLLING STEPPING MOTOR

CROSS-REFERENCE

The entire disclosure of Japanese Patent Application No. 2011-121443 filed on May 31, 2011, No. 2011-125427 filed on Jun. 3, 2011, and No. 2011-128044 filed on Jun. 8, 2011 which are hereby incorporated by reference in its entirety.

BACKGROUND

In the related art, a cutting apparatus configured to cut a processed tape including a first cutting mechanism having a full-cutting function, a second cutting mechanism having a half-cutting function, a single cutter motor configured to drive the first and second cutting mechanisms, and a driving mechanism configured to drive the first cutting mechanism and the second cutting mechanism on the basis of driving of the cutter motor is known (see Japanese Patent No. 4539620). The second cutting mechanism includes a cradle and a movable blade which can be moved toward and away from the cradle, and is configured to form a space by a dimension corresponding to the thickness of the release tape between the movable blade and the cradle by bringing a pair of projecting portions provided at both end portions of the movable blade into abutment with the cradle, whereby cutting (half cutting) of the body tape of the processed tape is achieved. Also, at the time of the half cutting, reliable cutting is achieved by driving the cutter motor for seconds longer than those required for bringing the projecting portions of the movable blade into abutment with the cradle, so that a clear half cutting is achieved. At that time, in order to prevent the cutter motor from being applied with at least a certain amount of torque, a torque limiter is interposed in a transmitting mechanism of the driving mechanism. The torque limiter includes a pair of gears and a coil spring interposed between the both gears.

However, since the cutting apparatus of the related art as described above has a configuration to control a cutting force of the half cutter (the second cutting mechanism) using the torque limiter having a coil spring as a main structure, there is a problem in that the cutting force of the half cutter is not stable due to the error in accuracy around the coil spring. In other words, the coil spring itself has errors in accuracy in spring force and spring stroke, and the coefficient of static friction between the coil spring and a portion receiving the coil spring becomes an error in accuracy, so that the control value of the torque is not stabilized. Therefore, the stable cutting force cannot be obtained at the time of the half cutting, and such an event that the body tape is also cut or the release tape is not cut occurs. There is also a problem that the apparatus becomes complex and is upsized by mounting the torque limiter.

SUMMARY

Various embodiments may provide a tape cutting apparatus which achieves cutting force control of a half cutter with a simple structure with high degree of accuracy, a tape printing apparatus having the same, and a method of controlling a stepping motor.

An aspect of the invention is directed to a tape cutting apparatus including: a half cutter configured to cut a body tape or a release tape with respect to a processed tape having the release tape adhered to the body tape; a stepping motor configured to cause the half cutter to perform a cutting operation; and a motor control unit configured to control the stepping motor, wherein the motor control unit is configured to continue the cutting operation until the stepping motor loses steps.

Another aspect of the invention is directed to a method of controlling a stepping motor constituting a power source of a half cutter configured to cut a body tape or a release tape of a processed tape having the body tape and the release tape adhered thereto, including: allowing a cutting operation by the half cutter to continue until the stepping motor loses steps.

In these configurations, by continuing the cutting operation, the half cutter comes into abutment with the processed tape and the torque of the stepping motor is gradually increased and, finally, reaches a step-out torque, (bringing the stepping motor into a step-out state). When the stepping motor is brought into the step-out state, the torque is not increased any longer, and hence the torque is stabilized at the step-out torque as long as the cutting operation is continued. In contrast, the step-out torque is adjusted by the cycle of the drive pulse on the basis of the torque characteristic of the stepping motor. In other words, the torque of the stepping motor is controlled to a predetermined step-out torque adjusted in advance by continuing the cutting operation until the stepping motor is brought into the step-out state using the stepping motor. In this manner, the torque corresponding to a cutting force is controlled to a predetermined value only by controlling the stepping motor, so that the control of the cutting force of the half cutter can be performed with high degree of accuracy in a simple configuration.

In the tape cutting apparatus, it is preferable that, the motor control unit maintains the step-out state by an amount corresponding to $n(10 \leq n \leq 5000)$ steps of a drive pulse to be applied to the stepping motor.

In the tape cutting apparatus, it is preferable that the step-out state for $t(0.1 \leq t \leq 2)$ seconds is maintained in the motor control unit.

In these configurations, since the stepping motor continues to be driven by an amount corresponding to n steps and/or for t seconds even after the stepping motor loses steps in order to maintain the step-out state, cutting of only the body tape or the release tape is reliably achieved, and the half cutting with high degree of accuracy is achieved.

In the tape cutting apparatus, it is preferable that a plurality of types of the processed tape having different cutting loads can be cut individually, a tape type detecting unit configured to detect the type of the plurality of types of the processed tape is further provided, the half cutter performs cutting of the processed tapes individually, and the motor control unit includes a modulating unit configured to vary the cycle of the drive pulse to be applied to the stepping motor on the basis of the result of detection of the tape type detecting unit.

In the method of controlling a stepping motor, it is preferable that the stepping motor cuts a plurality of types of the processed tapes having different loads individually by operating the half cutter, and the types of the plurality of types of the processed tapes are detected and the cycle of the drive pulse to be applied to the stepping motor is varied on the basis of the result of detection.

In these configurations, the torque can be adjusted according to the cutting load by modulating the cycle of the drive pulse according to the type of the processed tape. Accordingly, the cutting operation can be performed in a simple structure and adequately without using the torque limiter or the like with respect to the plurality of types of the processed tapes having different cutting loads. The type of the processed tape may include, for example, the material, the width, and the thickness of the processed tape.

In the tape cutting apparatus, it is preferable that the tape type detecting unit is configured to detect the width of at least the plurality of types of the processed tape.

In this configuration, an adequate cutting operation is performed on the processed tape having different tape widths.

In the tape cutting apparatus, it is preferable that the tape cutting apparatus further includes a full cutter configured to be driven by an input of one of the normal rotation and the reverse rotation of the stepping motor to cut the processed tape and the half cutter is driven by an input of the other one of the normal and reverse rotations of the stepping motor, and the motor control unit includes a modulating unit configured to vary the cycles of the drive pulses in the normal rotation and the reverse rotation to be applied to the stepping motor respectively according to the loads of the full cutter and the load of the half cutter.

In this case, the tape cutting apparatus further includes a power transmitting unit having a first input unit configured to input one of the normal rotation and the reverse rotation of the stepping motor to the full cutter, and a second input unit configured to input the other one of the normal rotation and the reverse rotation of the stepping motor to the half cutter.

In the method of controlling a stepping motor, it is preferable that the stepping motor constitutes a single power source for the full cutter configured to be driven by an input of one of the normal rotation and the reverse rotation and to cut the processed tape and the half cutter configured to be driven by an input of the other one of the normal rotation and the reverse rotation, and is configured to vary the cycles of the drive pulses in the normal rotation and the reverse rotation to be applied to the stepping motor according to the loads of the full cutter and the load of the half cutter respectively.

In these configurations, by modulating the cycle of the drive pulse of the stepping motor between one of the normal rotation and the reverse rotation which drives the full cutter and the other one of the normal rotation and the reverse rotation which drives the half cutter, the speed of rotation and the torque of the full cutter at the time of being driven and the speed of rotation and the torque of the half cutter at the time of being driven may be differentiated. In other words, by modulating the cycle of the drive pulse according to the load of the respective cutters, adequate cutter-to-cutter torque control and adequate operation speed may be realized. In this manner, the torque control from cutter to cutter can be performed in a simple configuration and adequately without using the torque limiter, a complex power transmitting mechanism or the like.

Still another aspect of the invention is directed to a tape printing apparatus including the tape cutting apparatus described above and a printing unit configured to perform printing on the processed tape fed to the tape cutting apparatus.

In this configuration, by using the tape cutting apparatus as described above, a label with a half-cutting function can be created with high degree of accuracy in a simple configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring now to the attached drawings, a tape cutting apparatus according to an embodiment of the invention, a tape printing apparatus having the same, and a method of controlling a stepping motor will be described. In this embodiment, the tape printing apparatus having a half-cutting function will be described. The tape printing apparatus is configured to perform printing on a printing tape (processed tape) as a printed object while feeding the same, then cutting the printed portion of the printing tape while performing half cutting of the printing tape as needed, and creating a label. In this embodiment, the terms "front", "rear", "left", "right", "up", and "down" are directions (front view) viewed from a user who uses the tape printing apparatus.

Figure 1:
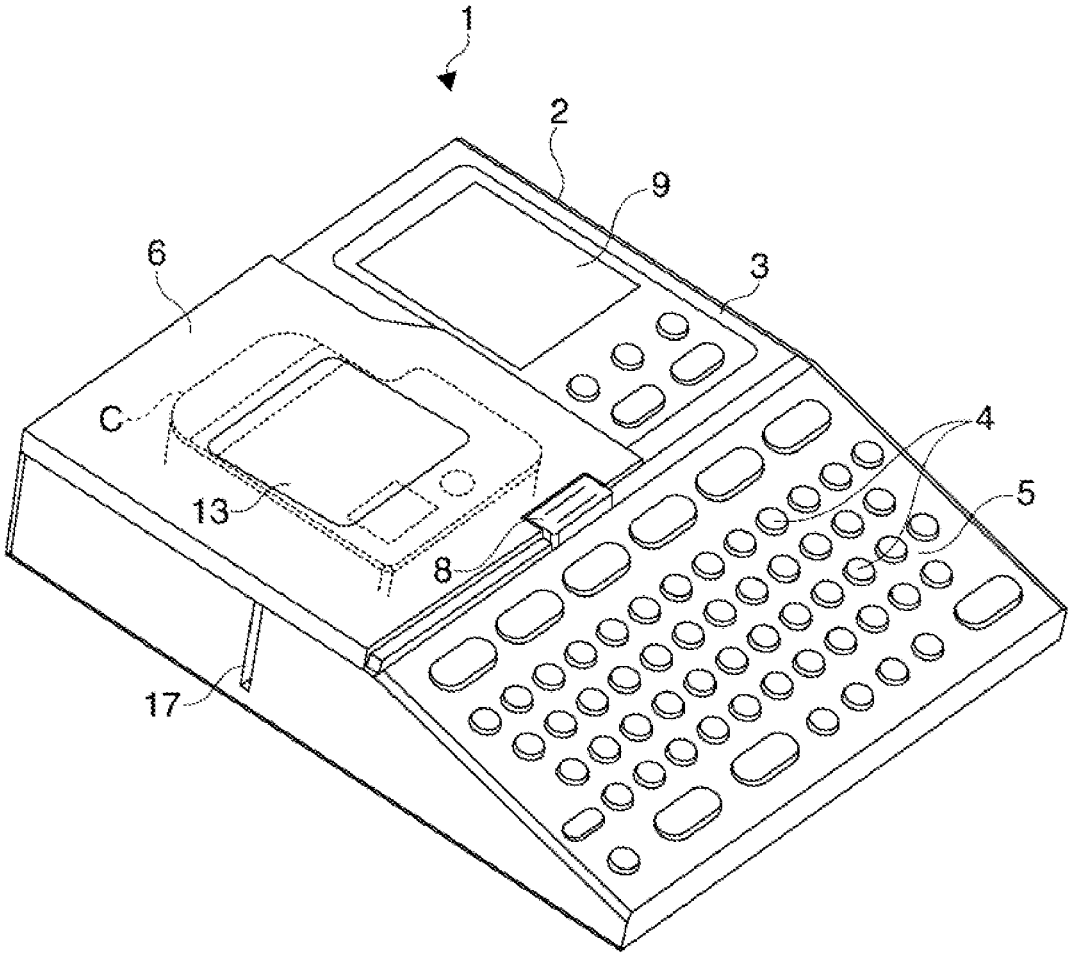
FIG. 1 is an appearance perspective view of a tape printing apparatus in a state in which a lid is closed according to an embodiment.
Figure 2:
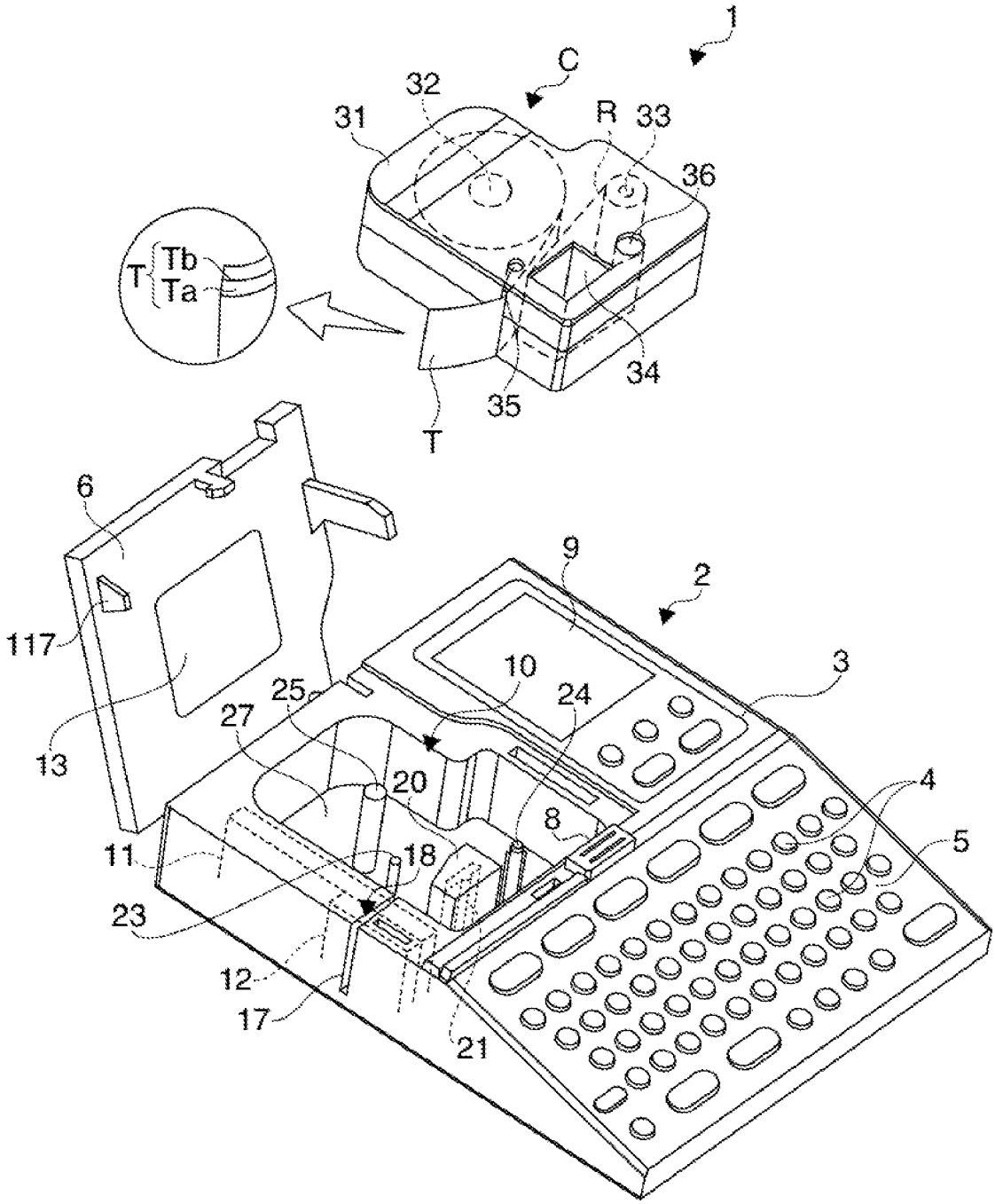
FIG. 2 is an appearance perspective view of the tape printing apparatus in a state in which the lid is opened.

As shown in FIG. 1 and FIG. 2, a tape printing apparatus 1 includes an apparatus body 2 performing a printing process on a printing tape T, and a tape cartridge C configured to store the printing tape T and an ink ribbon R and demountably mounted freely on the apparatus body 2. The printing tape T with a release tape Tb as the printed object is stored in the tape cartridge C so as to be fed freely.

An outline of the apparatus body 2 is formed by an apparatus case 3, and a keyboard 5 having various keys 4 is disposed on an upper surface of a front half portion of the apparatus case 3. In contrast, an opening and closing lid 6 is provided widely on a left upper surface of a rear half portion on the apparatus case 3, and a lid body opening button 8 for opening the opening and closing lid 6 is provided on the front side of the opening and closing lid 6. In addition, a rectangular display 9 configured to display input result or the like by the keyboard 5 is disposed on a right upper surface of the rear half portion of the apparatus case 3.

When the opening and closing lid 6 is opened by pressing the lid body opening button 8, a cartridge mounting portion 10 for mounting the tape cartridge C is formed in the interior thereof so as to be depressed, and the tape cartridge C is mounted so as to be demountable with respect to the cartridge mounting portion 10 in a state of opening the opening and closing lid 6. The opening and closing lid 6 is formed with an inspection window 13 for visually recognizing mounting and demounting of the tape cartridge C in a state of being closed.

A tape discharging port 17 continuing from the cartridge mounting portion 10 is formed on a left side portion of the apparatus case 3, and a tape discharging route 18 is formed between the cartridge mounting portion 10 and the tape discharging port 17 (see FIG. 2). Then, a tape cutting mechanism 11 configured to cut the printing tape T, and a tape discharging mechanism 12 configured to discharge a tape strip of the printing tape T after the cutting from the tape discharging port 17 are assembled and are integrated in the interior of the apparatus case 3 (described later in detail) from the upstream side so as to face the tape discharging route 18. The tape cutting mechanism 11 includes a full cutter 61 and a half cutter 62, and is configured to be capable of performing full cutting which cuts the printing tape T completely, and half cutting which cuts only a recording tape (body tape) Ta.

In contrast, the cartridge mounting portion 10 includes a thermal type printing head 21 having a plurality of heat generating elements in the interior of the head cover 20, a platen drive shaft 23 opposing the printing head 21, a winding drive shaft 24 configured to wind the ink ribbon R described later, and a positioning projection 25 for a tape reel 32 described later disposed therein. The platen drive shaft 23 and the winding drive shaft 24 penetrate through a bottom plate 27 of the cartridge mounting portion 10, and a tape feeding power system 26 (see FIGS. 3A and 3B) as a power system which drives the platen drive shaft 23 and the winding drive shaft 24 is disposed in a space below the bottom plate 27.

The tape cartridge C includes the tape reel 32 on which the printing tape T is wound in an upper center portion in the interior of a cartridge case 31 and a ribbon reel 33 on which the ink ribbon R is wound in a lower right portion stored so as to be freely rotatable (see FIG. 2) and the printing tape T and the ink ribbon R are formed to have the same width. The tape reel 32 is formed with a through hole 34 to be inserted into a head cover 20 which covers the printing head 21 at a lower left portion thereof. Furthermore, a platen roller 35 fitted on the platen drive shaft 23 to be driven and rotated thereby is arranged at a position corresponding to a portion where the printing tape T and the ink ribbon R are overlapped in the vicinity of the through hole 34. In contrast, a ribbon winding reel 36 in which the winding drive shaft 24 is fitted to be driven and rotated thereby is arranged in the proximity of the ribbon reel 33.

When the tape cartridge C is mounted in the cartridge mounting portion 10, the head cover 20 is inserted into the through hole 34, the positioning projection 25 is inserted into a center hole of the tape reel 32, the platen drive shaft 23 is inserted into a center hole of the platen roller 35, and the winding drive shaft 24 is inserted into a center hole of the ribbon winding reel 36, respectively. The printing tape T is fed from the tape reel 32 by the rotation and driving of the platen drive shaft 23 and the winding drive shaft 24, and the ink ribbon R is fed from the ribbon reel 33 so as to be fed with the printing tape T together in a stacked manner at a portion of the through hole 34, and the printing tape T is fed to the outside from the cartridge case 31 and the ink ribbon R is wound by the ribbon winding reel 36. At a portion where the printing tape T and the ink ribbon R are fed together, the platen roller 35 and the printing head 21 face the printing tape T and the ink ribbon R so as to clamp therebetween, and so-called print feeding is performed.

The printing tape T includes the recording tape (body tape) Ta formed with an adhesive agent layer on the back surface thereof and the release tape Tb adhered to the recording tape Ta by the adhesive agent layer. The printing tape T is wound around the tape reel 32 with the recording tape Ta faced outside and the release tape Tb faced inside and stored. The printing tape T includes a plurality of types different in tape type (the tape width, the base color of the printing tape T, the land pattern, the material (texture), etc.), and are stored in the cartridge case 31 corresponding to the tape width together with the ink ribbon R. In other words, the types of the tape widths include "6 mm", "9 mm", "12 mm", "18 mm", "24 mm", and "36 mm", and the apparatus body 2 is configured to allow loading of these various types of printing tapes T individually via the tape cartridge C.

Provided on the back surface of the cartridge case 31 are a plurality of holes (not shown) for specifying the type of the printing tape T. In contrast, a plurality of tape identification sensors (tape type detecting unit) 37 such as micro switches for detecting bit patterns (see FIG. 8) are provided in the cartridge mounting portion 10 corresponding to a plurality of holes, so that the tape type (especially, the tape width) may be determined by detecting the state of the plurality of holes by the tape identification sensor 37.

When the opening and closing lid 6 is closed with the tape cartridge C mounted in the cartridge mounting portion 10, the printing head 21 is rotated via a head release mechanism, not shown to clamp the printing tape T and the ink ribbon R between the printing head 21 and the platen roller 35, whereby the tape printing apparatus 1 is brought into a print waiting state. When an instruction of the printing operation is issued after the input and edition of print data, the platen roller 35 is driven to rotate to feed the printing tape T from the tape cartridge C and the printing head 21 is driven to perform desired printing on the printing tape T. With this printing operation, the ink ribbon R is wound in the tape cartridge C, and the printed portion of the printing tape T is fed out from the tape discharging port 17 to the outside of the apparatus. When printing is completed, the feeding of a portion of a blank space is performed, and traveling of the printing tape T and the ink ribbon R is stopped. Subsequently, the printing tape T is subjected to the half cutting by the tape cutting mechanism 11 and almost simultaneously, the printed portion of the printing tape T is cut (fully cut). Accordingly, the label including desired characters or the like printed thereon is created. The tape strip after the cutting is discharged from the tape discharging port 17 by the operation of the tape discharging mechanism 12.

Referring now to FIGS. 3A and 3B to FIG. 7, the tape feeding power system 26, the tape cutting mechanism 11, and the tape discharging mechanism 12 are described, respectively. The tape feeding power system 26 includes a tape feeding motor 41 as a power source, and a feeding power transmitting mechanism 42 configured to transmit the power of the tape feeding motor 41 to the platen drive shaft 23 and the winding drive shaft 24. In other words, the tape feeding motor 41 is used as a power source for the platen drive shaft 23 and the winding drive shaft 24. Although detailed description will be given later, the tape feeding motor 41 is also used as the power source of a discharge drive roller 111 of the tape discharging mechanism 12.

Figure 3A:
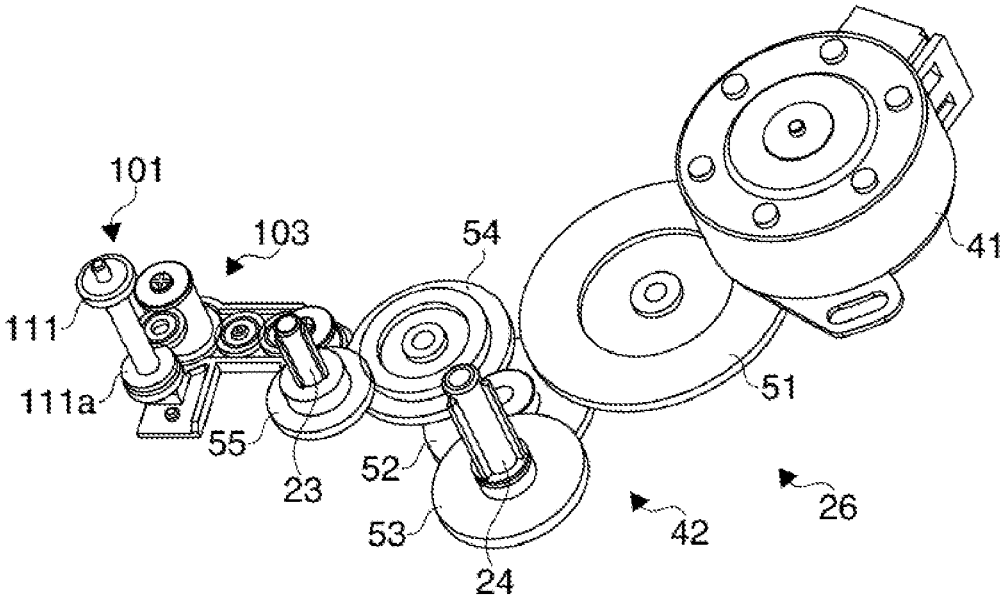
FIG. 3A is a perspective view showing a tape feeding power system.
Figure 3B:
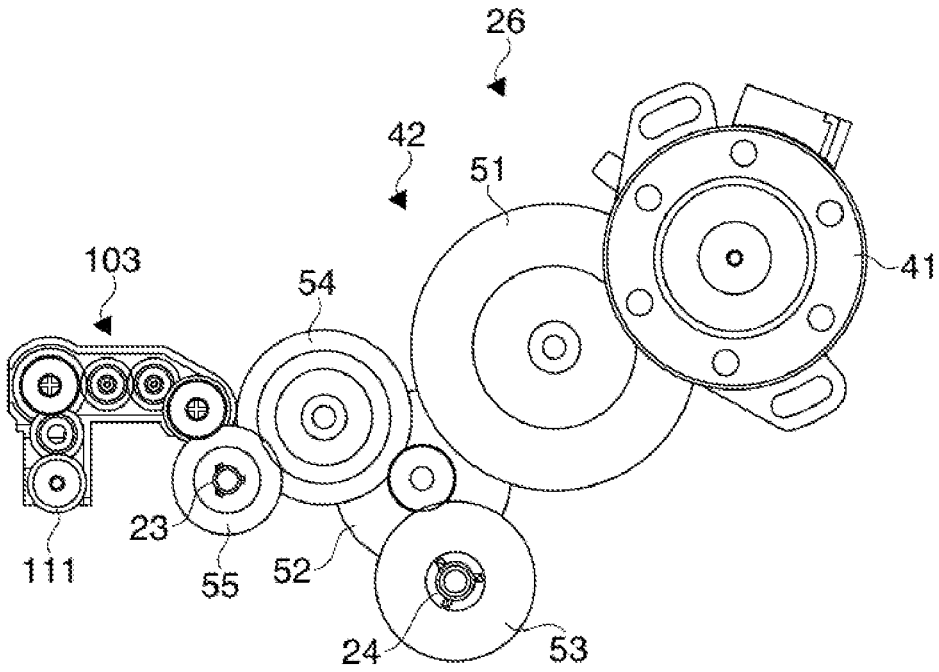
FIG. 3B is a plan view of the tape feeding power system.

As shown in FIGS. 3A and 3B, the feeding power transmitting mechanism 42 includes an input gear 51 configured to mesh a gear formed on a main shaft of the tape feeding motor 41, a diverging gear 52 configured to mesh the input gear 51 and diverging the power source to two directions toward the platen drive shaft 23 and the winding drive shaft 24, a first output gear 53 configured to mesh the diverging gear 52 and supported to rotate by the winding drive shaft 24, a relay gear 54 configured to mesh the diverging gear 52, and a second output gear 55 configured to mesh the relay gear 54 and supported to rotate by the platen roller 35. When the tape feeding motor 41 is driven, the platen drive shaft 23 and the winding drive shaft 24 are rotated via respective gears. Accordingly, the transportation of the ink ribbon R is performed synchronously with the tape feed of the printing tape T.

Figure 4:
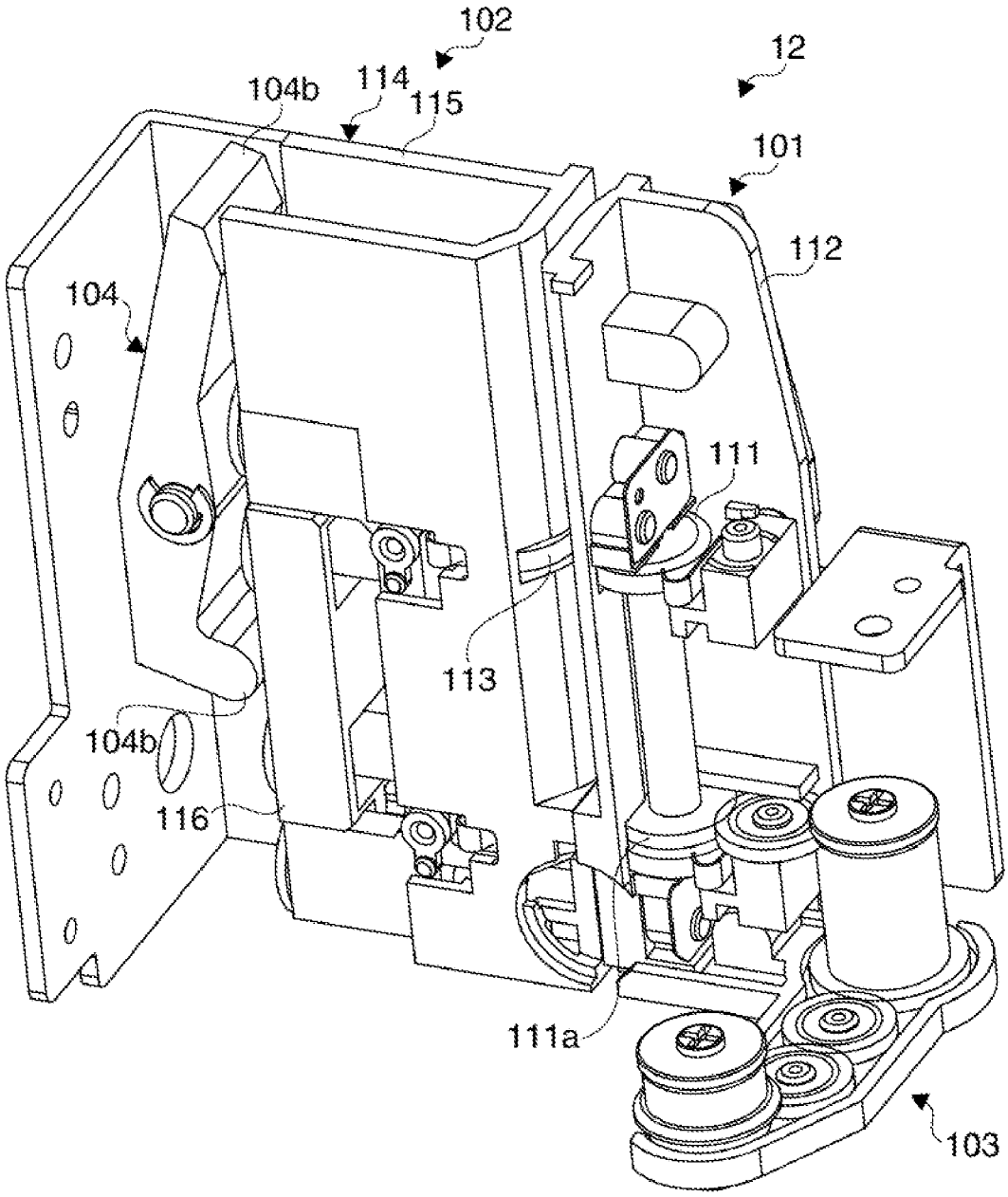
FIG. 4 is a perspective view showing a tape discharging mechanism.
Figure 5A:
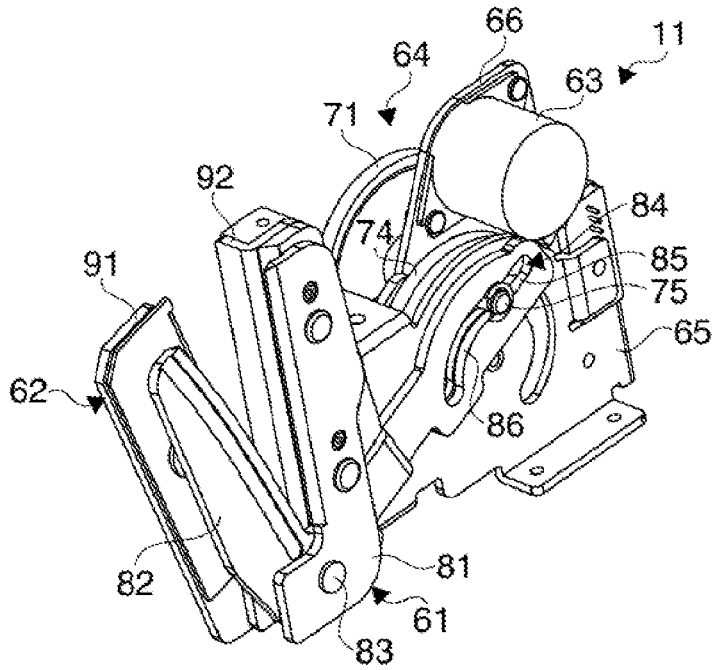
FIG. 5A is a perspective view showing a tape cutting mechanism.
Figure 5B:
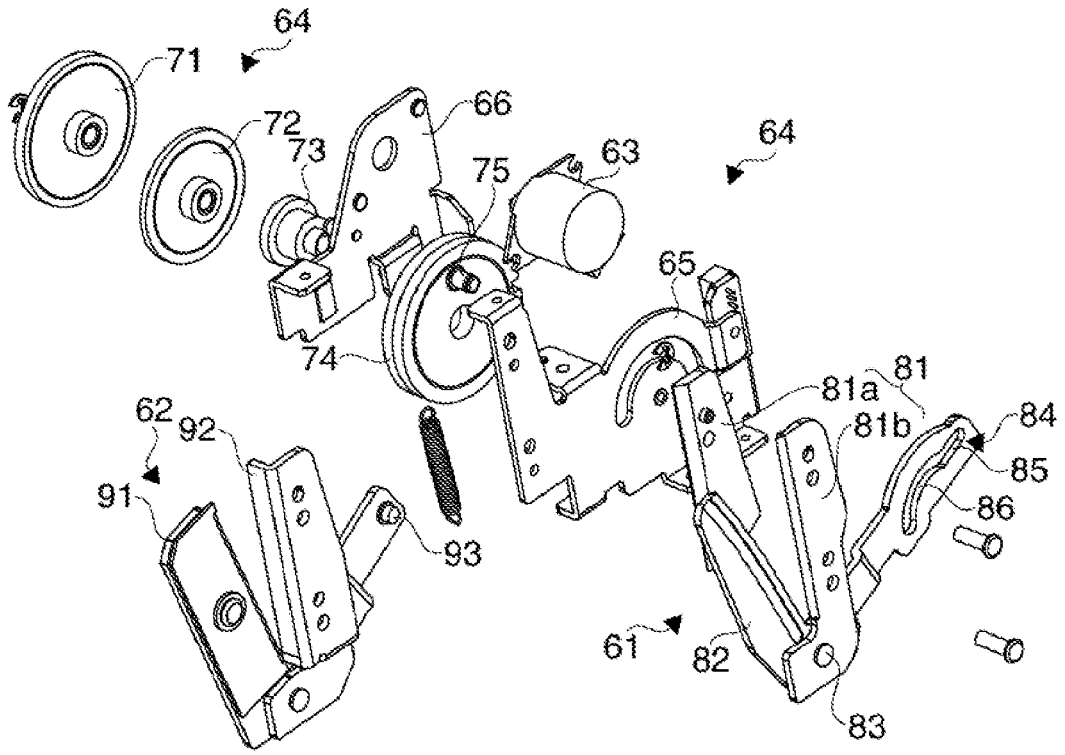
FIG. 5B is an exploded perspective view of the tape cutting mechanism.
Figure 6A:
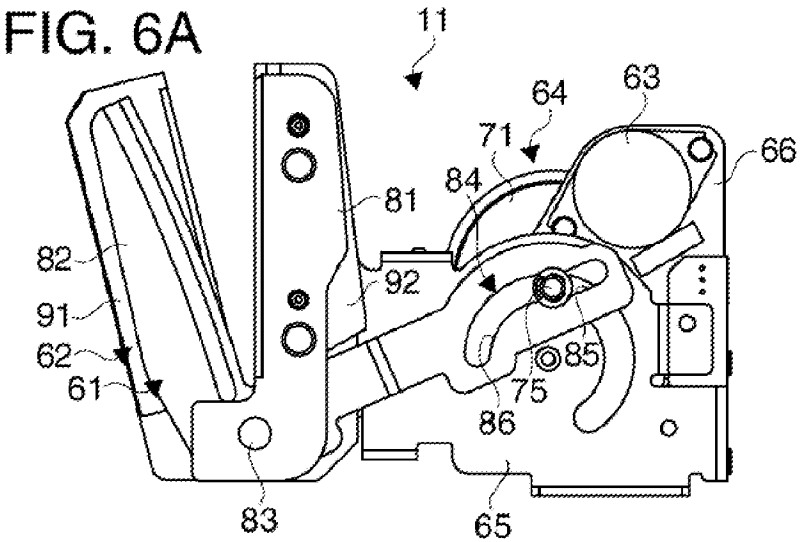
FIG. 6A is a right side view showing the tape cutting mechanism.
Figure 6B:
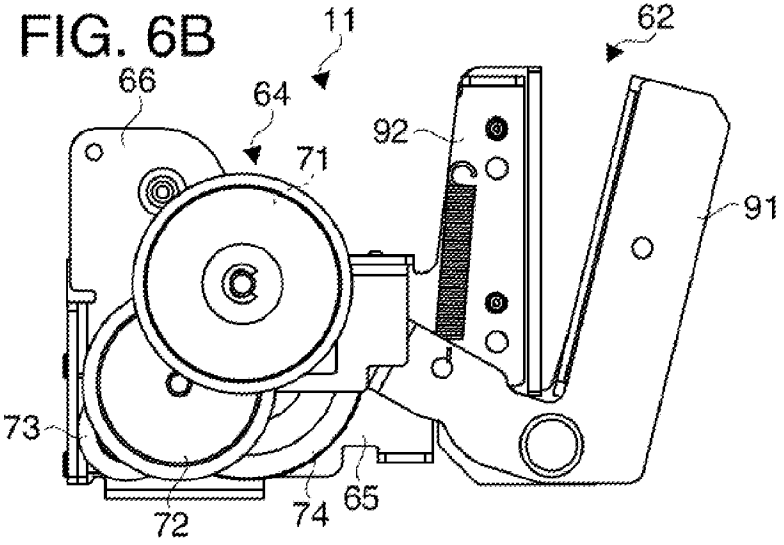
FIG. 6B is a left side view showing the tape cutting mechanism.
Figure 6C:
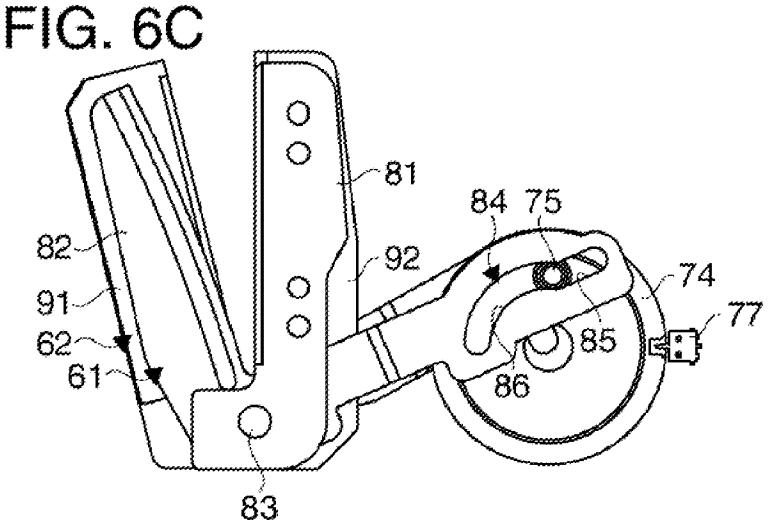
FIG. 6C is a right side view showing a periphery of a crank disk.
Figure 6D:
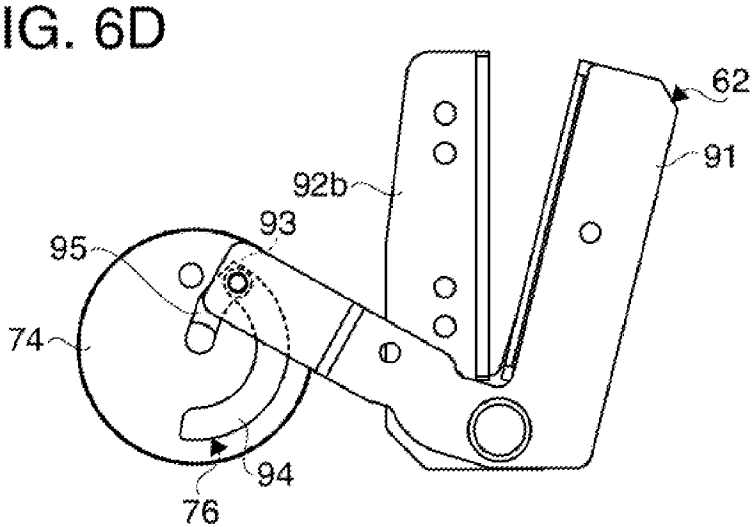
FIG. 6D is a left side view showing the periphery of the crank disk.
Figure 7:
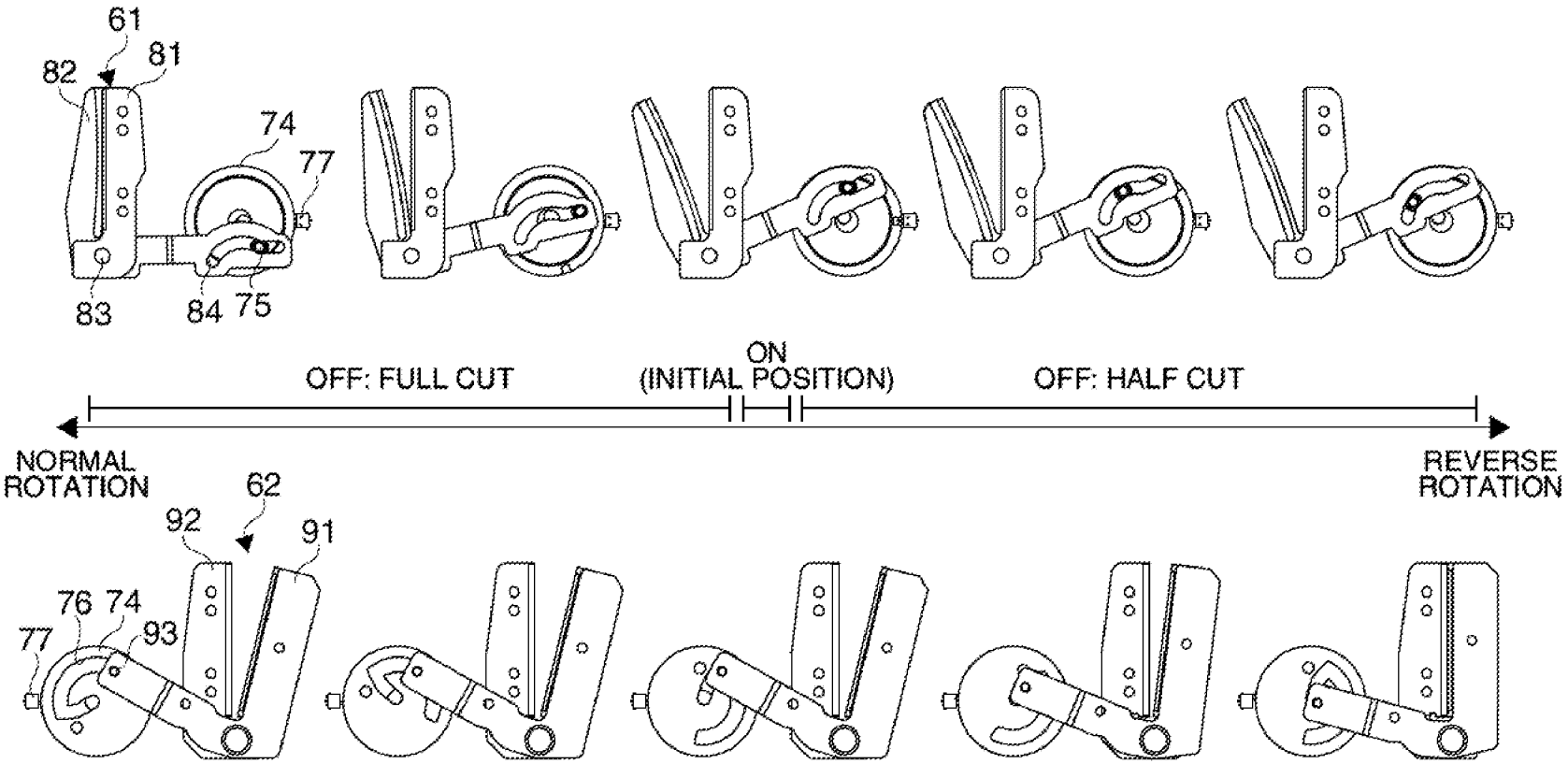
FIG. 7 is a drawing showing a behavior of full cutting and half cutting by the rotation of the crank disk in the normal and reversed direction.

As shown in FIGS. 3A and 3B and FIG. 4, the tape discharging mechanism 12 includes a drive roller unit 101 having the discharge drive roller 111, a driven roller unit 102 having a discharging driven roller 113 opposing the discharge drive roller 111, a discharge power transmitting mechanism. 103 transmitting the power of the tape feeding motor 41 to the discharge drive roller 111, and a rotary lever 104 configured to move the discharging driven roller 113 between a clamping position and a retracted position in association with the opening and closing of the opening and closing lid 6. In other words, the discharging roller for discharging the printing tape T is configured by nip rollers including the discharge drive roller 111 and the discharging driven roller 113.

The drive roller unit 101 includes the discharge drive roller 111 configured to rotate in contact with the release tape Tb side of the printing tape T, and a drive roller holder 112 configured to support the discharge drive roller 111 so as to be rotatable. The discharge power transmitting mechanism 103 includes a gear train including five gears, and an upstream end meshes the second output gear 55 and a downstream end meshes a gear portion 111*a* of the discharge drive roller 111 (see FIGS. 3A and 3B). In other words, when the tape feeding motor 41 is driven, the discharge drive roller 111 rotates together with the platen drive shaft 23 and the winding drive shaft 24. Accordingly, the tape discharging mechanism 12 is driven synchronously with the tape feed of the printing tape T (the rotation of the platen roller 35). For reference, a tape presence detecting circuit 118 (see FIG. 8) configured to detect whether or not the printing tape T is present between the discharge drive roller 111 and the discharging driven roller 113 is electrically connected to the discharge drive roller 111. Accordingly, determination of abnormality of the tape feed is performed.

The driven roller unit 102 includes the discharging driven roller 113 configured to rotate in contact with the recording tape Ta side of the printing tape T and a driven roller holder 114 configured to rotatably support the discharging driven roller 113. The driven roller holder 114 includes a fixed holder 115 fixed to a base frame, a movable holder 116 configured to be slidably supported by the fixed holder 115 and supporting the discharging driven roller 113, and a return spring (not shown) configured to urge the movable holder 116 to a retracted position.

The rotary lever 104 is rotatably supported by the driven roller holder 114 at a midsection thereof, is formed with an abutting portion 104*a* which comes into abutment with the movable holder 116 at a distal end thereof, and is formed with a projection receiving portion 104*b* which engages an operation projection 117 (see FIG. 2) provided on the opening and closing lid 6 at a rear end thereof. When the opening and closing lid 6 is closed, the operation projection 117 acts on the projection receiving portion 104*b*, and rotates the rotary lever 104. The abutting portion 104*a* acts on the movable holder 116 in association with the rotation of the rotary lever 104, and moves the discharging driven roller 113 to a clamping position via the movable holder 116. In the state of being positioned at the clamping position, the discharging driven roller 113 clamps the printing tape T in cooperation with the discharge drive roller 111. In contrast, when the opening and closing lid 6 is opened, the operation projection 117 does not act on the projection receiving portion 104*b* any longer, and hence the movable holder 116 is pressed by a return spring and the discharging driven roller 113 is retracted from the clamping position to the retracted position. In this manner, the rotary lever 104 moves the discharging driven roller 113 between the clamping position and the retracted position in association with the opening and closing of the opening and closing lid 6.

As shown in FIGS. 5A and 5B and FIGS. 6A to 6D, the tape cutting mechanism 11 includes the scissor type full cutter 61 configured to perform full cutting of the printing tape T, the push-cutting type half cutter 62 configured to perform half cutting of the printing tape T, a cutter motor 63 as a power source, a cutter power transmitting mechanism (power transmitting unit) 64 configured to transmit the power of the cutter motor 63 to the full cutter 61 and the half cutter 62, and a cutter frame 65 and a gear frame 66 configured to support the full cutter 61, the half cutter 62, the cutter motor 63, and the cutter power transmitting mechanism 64. In other words, the single cutter motor 63 is used as a power source for the full cutter 61 and the half cutter 62. The term "full cutting" described here means a cutting process for cutting the entirety of the printing tape T, that is, for cutting the recording tape Ta and the release tape Tb integrally, and the term "half cutting" is a cutting process for cutting only the recording tape Ta without cutting the release tape Tb.

The cutter motor 63 is a stepping motor and causes the full cutter 61 and the half cutter 62 to perform a cutting operation. Although the detailed description is given later, the full cutter 61 is operated by a normal rotation and a reverse rotation of the cutter motor 63 from an initial position, and the half cutter 62 is operated by a reverse rotation and a normal rotation of the cutter motor 63 from the initial position. At the time of the half cutting, a cutting torque to the printing tape T is controlled by using a step-out phenomenon of the stepping motor. Unlike a DC motor, in the stepping motor, burn-in of a coil does not occur in the step-out state. In other words, the cutter motor 63 is composed of a motor in which the burn-in of the coil does not occur in the step-out state.

The cutter power transmitting mechanism 64 includes a large-sized first gear 71 meshed with an input gear supported by (a main shaft of) the cutter motor 63, a second gear 72 configured to be meshed with the first gear 71, a small third gear 73 configured to be meshed with the second gear 72, and a crank disk 74 configured to be meshed with the third gear 73. An eccentric crank pin (first input unit) 75 is provided on a right end surface (the full cutter 61 side) of the crank disk 74, and is engaged with a base portion of a movable blade 82 of the full cutter 61. In contrast, a cam groove (second input unit) 76 is formed on a left end surface (the half cutter 62 side) of the crank disk 74, and a base portion of a cutting blade 91 of the half cutter 62 engages the cam groove 76. The cutter power transmitting mechanism 64 is provided with a cutter position detecting sensor 77 disposed so as to face a position on a peripheral surface of the crank disk 74. The cutter position detecting sensor 77 detects whether the rotational position of the crank disk 74 is an initial position (ON), a position rotated in the normal direction from the initial position (OFF:

full cutting), and a position rotated in the reverse direction from the initial position (OFF: half cutting) (see FIG. 7), and on the basis of the result of detection, detects positions of the movable blade 82-*e* of the full cutter 61 and the cutting blade 91 of the half cutter 62 (hereinafter, referred to as the cutter position).

The full cutter 61 is of a scissor-type including a fixed blade 81 and the movable blade 82 rotatably coupled to each other via a spindle 83, and is configured to be capable of performing the full cutting individually on the respective printing tapes T having different tape widths. The fixed blade 81 and the movable blade 82 are formed into an "L" shape, and an elongated hole 84 configured to engage the crank pin 75 of the crank disk 74 and convert the rotational operation of the crank pin 75 into a reciprocating cutting operation is provided at a proximal portion of the movable blade 82. The fixed blade 81 includes a blade 81*a* and a blade holder 81*b* having the blade 81*a* attached thereto, and the spindle 83 is fixed to a base portion of the blade holder 81*b*.

The shape of the elongated hole 84 of the full cutter 61 is formed so as to allow the normal rotation of the crank disk 74 to act on (to be input in) the full cutter 61 and not to allow the reverse rotation of the crank disk 74 to act on the full cutter 61 in cooperation with the crank pin 75 (to allow the full cutter 61 to idle). More specifically, the elongated hole 84 includes a straight hole portion 85 supporting the normal rotation and formed linearly and an arcuate hole portion 86 supporting the reverse rotation and formed into an arcuate shape formed continuously from each other. At the time of the normal rotation from the initial position, the crank pin 75 moves on the straight hole portion 85 and, simultaneously, comes into abutment with a side surface thereof, provides the movable blade 82 with a rotary load to rotate the movable blade 82. In contrast, at the time of the reverse rotation from the initial position, the crank pin 75 moves on the arcuate hole portion 86, and does not apply the rotary load to the movable blade 82 (see FIG. 7).

The half cutter 62 is of a push-cutting type including the cutting blade 91 configured to cut into the printing tape T and a blade receiving member 92 configured to receive the cutting blade 91 which is cut into the printing tape T, and is configured to be capable of performing the half cutting individually on the respective printing tapes T having different tape widths. The cutting blade 91 is rotatably attached to the blade receiving member 92, and at the time of the half cutting, the cutting blade 91 cuts the recording tape Ta by the push-cutting in a state in which the cutting blade 91 is in contact with the entire area of the recording tape Ta. The cutting blade 91 is formed with an engaging projection 93 configured to engage the cam groove 76 of the crank disk 74 on a proximal portion of the cutting blade 91.

The shape of the cam groove 76 of the crank disk 74 is formed so that the normal rotation of the crank disk 74 does not act on the half cutter 62 (the half cutter 62 idles) and the reverse rotation of the crank disk 74 acts (inputs) on the half cutter 62 in cooperation with the engaging projection 93. More specifically, the cam groove 76 includes an arcuate-shaped arcuate groove portion 94 supporting the normal rotation and extending along the periphery and an inwardly extending groove portion 95 extending from the arcuate groove portion 94 toward the center side formed continuously. At the time of the normal rotation from the initial position, the engaging projection 93 relatively moves on the arcuate groove portion 94, and does not apply a rotary load to the cutting blade 91. In contrast, at the time of the reverse rotation from the initial position, the engaging projection 93 relatively moves on the inwardly extending groove portion 95 and, simultaneously, comes into abutment with a side surface of the inwardly extending groove portion 95, provides the cutting blade 91 with a rotary load to rotate the cutting blade 91 (see FIG. 7).

In other words, the cutter power transmitting mechanism 64 is configured to transmit (input) the rotary power in the normal rotation of the cutter motor 63 from the initial position to the full cutter 61, and transmit (input) the rotational power in the reverse rotation to the half cutter 62. Furthermore, the reciprocal rotary movement at the rotational position on the normal rotation side from the initial position is converted into the reciprocal movement of the movable blade 82 and the reciprocal rotational movement at the rotational position on the reverse rotation side from the initial position is converted into the reciprocal movement of the cutting blade 91.

Figure 8:
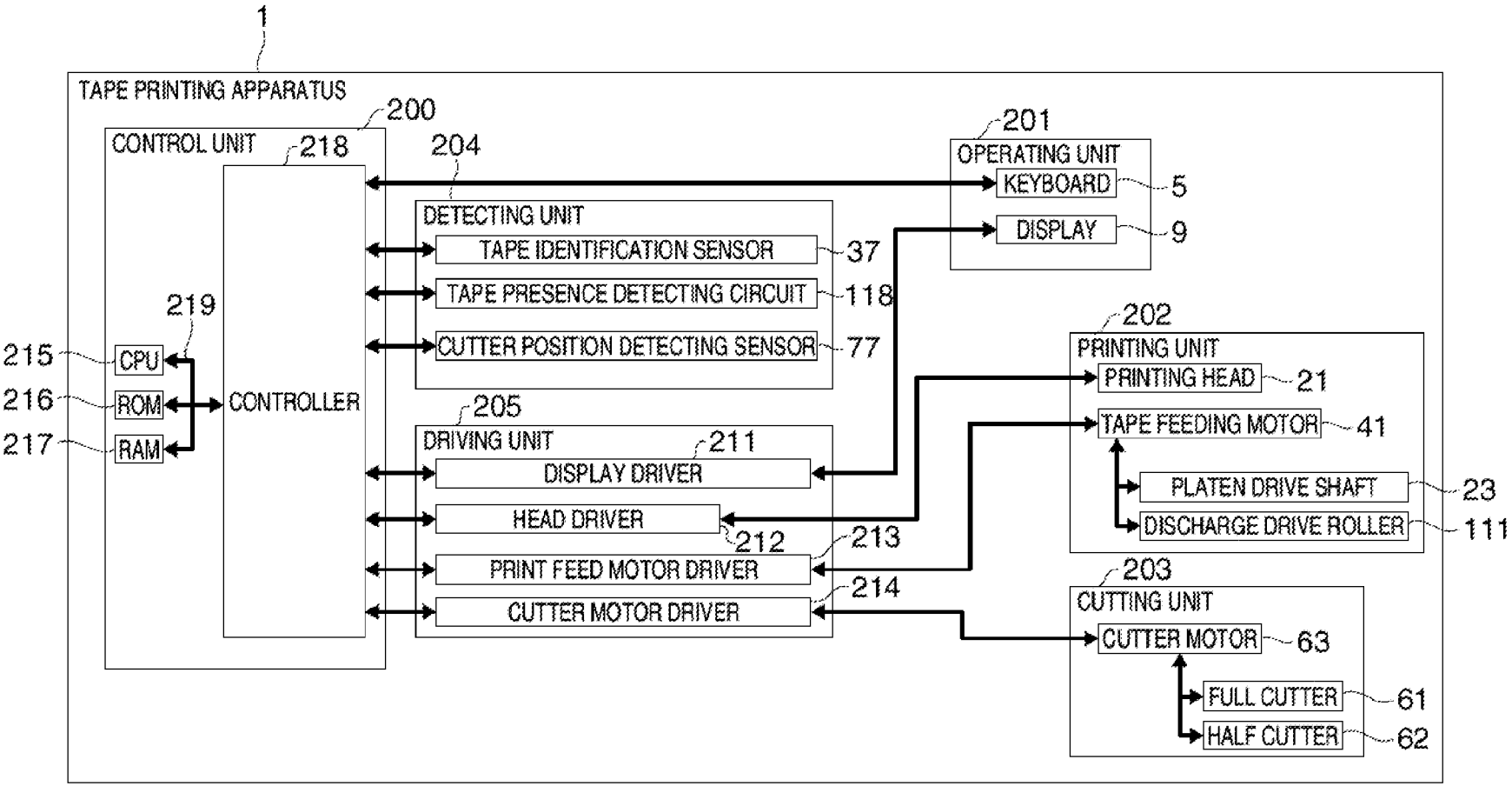
FIG. 8 is a control block diagram of the tape printing apparatus.

Referring now to FIG. 8, the control system of the tape printing apparatus 1 will be described. The tape printing apparatus 1 includes an operating unit 201, a printing unit (printing device) 202, a cutting unit (tape cutting apparatus) 203, and a detecting unit 204. The tape printing apparatus 1 is further provided with a driving unit 205 including a display driver 211 configured to drive the display 9, a head driver 212 configured to drive the printing head 21, a print feed motor driver 213 configured to drive the tape feeding motor 41, and a cutter motor driver 214 configured to drive the cutter motor 63. Then, the tape printing apparatus 1 includes a control unit (motor control unit and modulating unit) 200 connected to the respective members described above and configured to control the entirety of the tape printing apparatus 1.

The operating unit 201 includes the keyboard 5 and the display 9, and functions as an interface with the user such as input of character information from the keyboard 5 or display of various items of information on the display 9. The printing unit 202 includes the tape feeding motor 41 and the printing head 21 for rotating the platen roller 35 and the discharge drive roller 111, and rotates the platen roller 35 by the driving of the tape feeding motor 41 to feed the printing tape T. In addition, the printing head 21 is driven on the basis of the input character information, whereby the printing tape T being fed is printed. The printing unit 202 rotates the discharge drive roller 111 by driving of the tape feeding motor 41 to discharge the printing tape T. The cutting unit 203 includes the cutter motor 63 configured to operate the full cutter 61 and the half cutter 62, and the full cutter 61 and the half cutter 62 perform the half cutting or the full cutting with respect to the printing tape T after printing by the driving of the cutter motor 63. The detecting unit 204 includes the tape identification sensor 37, the tape presence detecting circuit 118, and the cutter position detecting sensor 77, performs detection of the tape type (especially the tape width), detection of the cutter position, and detection of the presence or absence of the printing tape T, and outputs the respective results of detection to the control unit 200.

The control unit 200 includes a CPU (Central Processing unit) 215, a ROM (Read Only Memory) 216, a RAM (Random Access Memory) 217, and a controller (IOC: Input Output Controller) 218, and is connected to each other with an inner bus 219. Then, the CPU 215 inputs respective signals and data from respective portions in the tape printing apparatus 1 via the controller 218 according to a control program in the ROM 216. The CPU 215 also processes the respective data in the RAM 217 on the basis of the input respective signals and data and outputs respective signal data to respective portions in the tape printing apparatus 1 via the controller 218. Accordingly, for example, the control unit 200 controls the printing process or the cutting process on the basis of the result of detection by the detecting unit 204.

Figure 9:
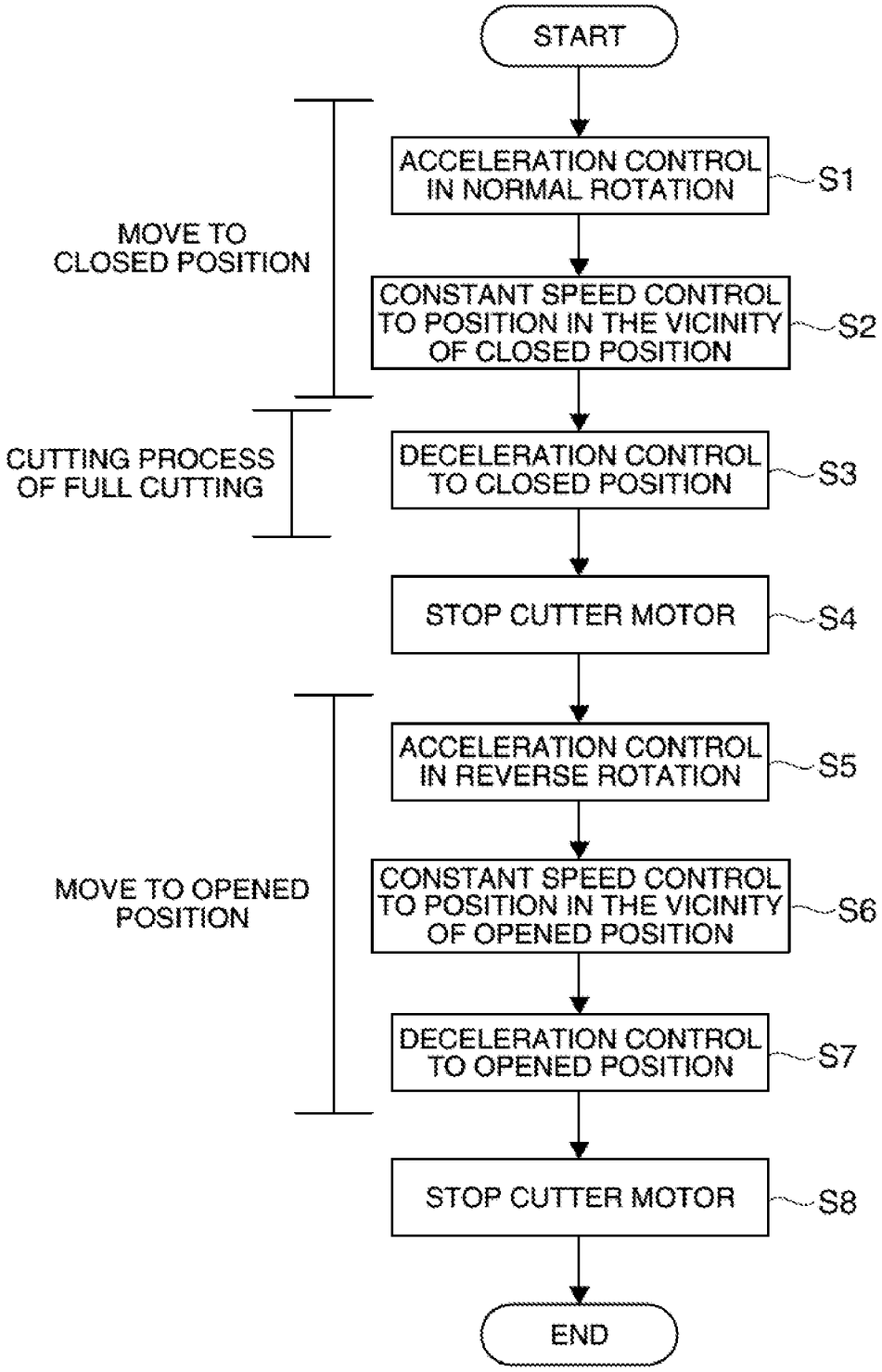
FIG. 9 is a flowchart of a full cutting operation.
Figure 10:
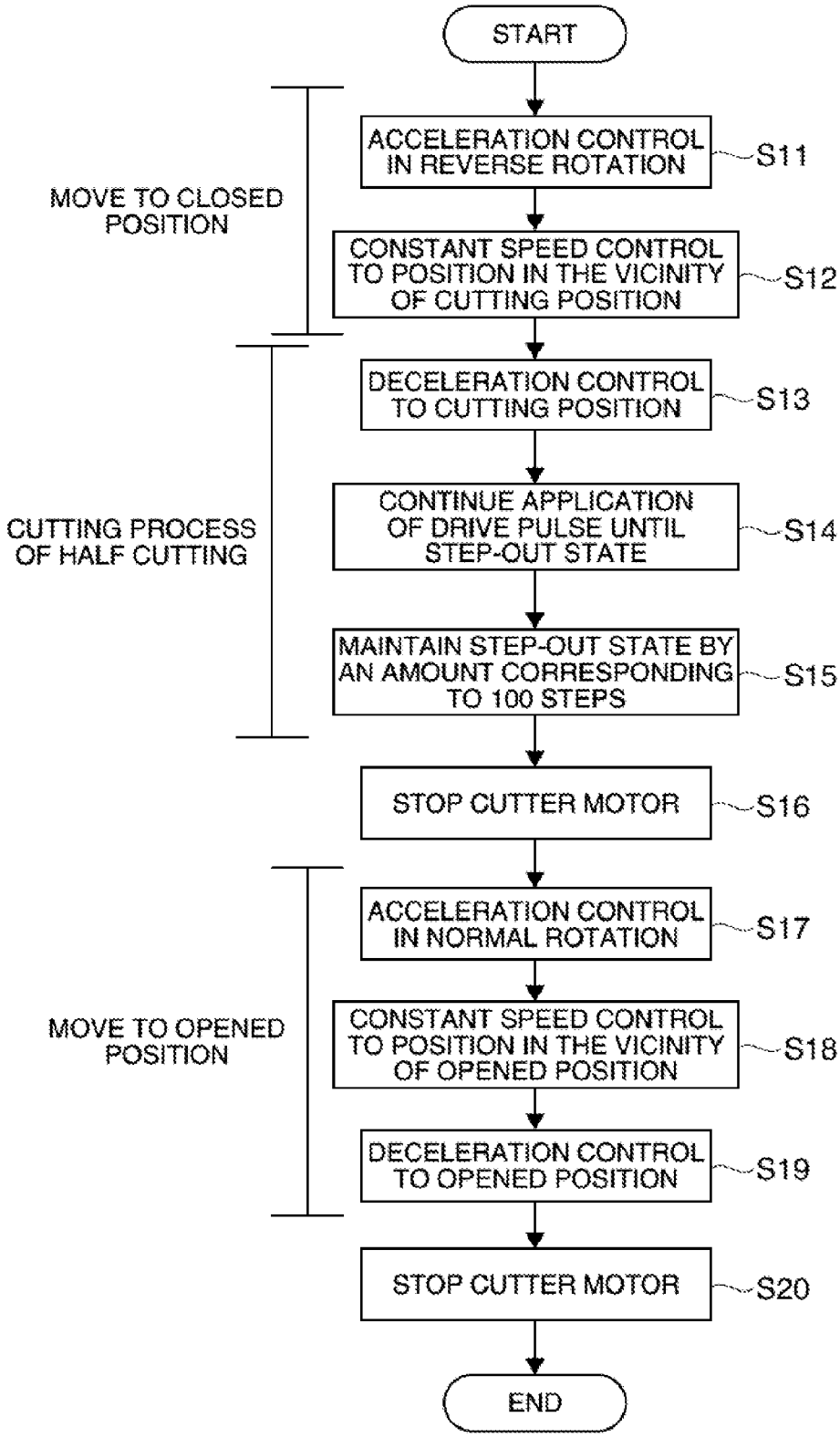
FIG. 10 is a flowchart of a half cutting operation.
Figure 11A:
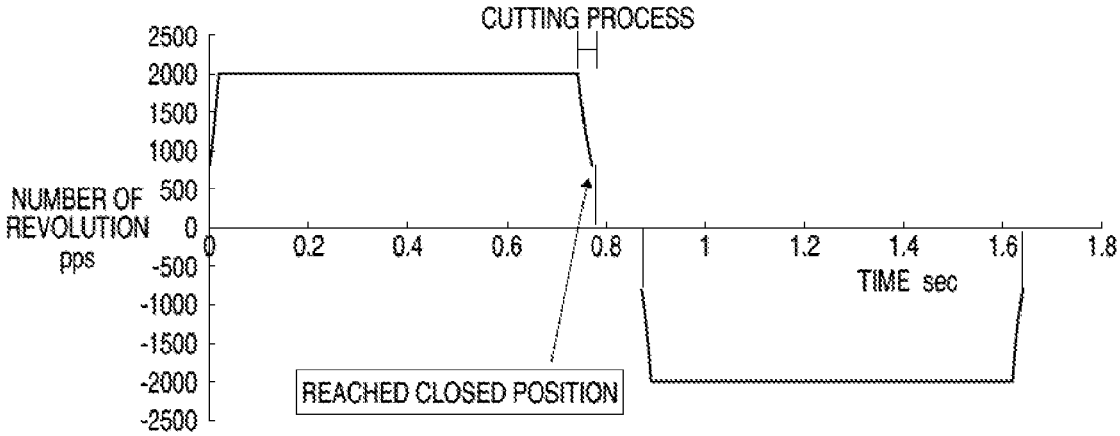
FIG. 11A is a drawing showing an operation sequence of the full cutting operation.
Figure 11B:
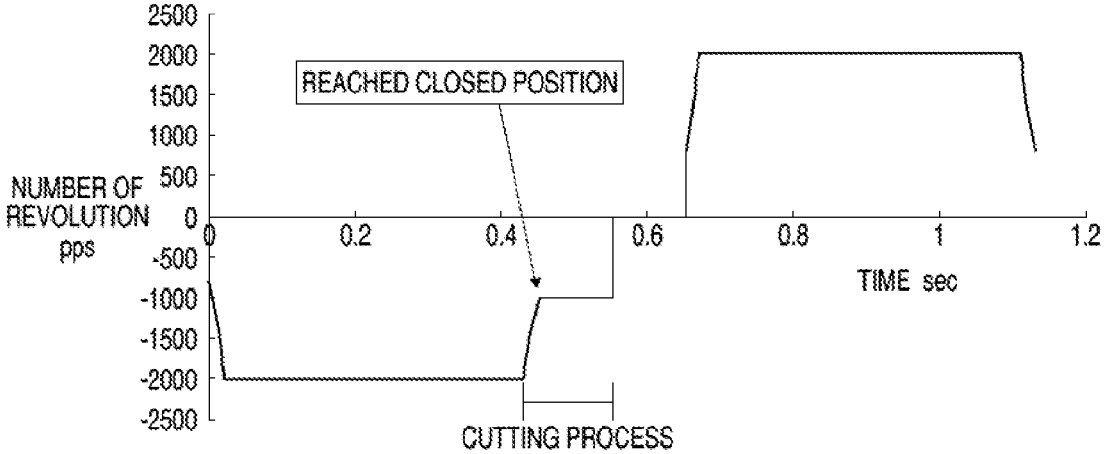
FIG. 11B is a drawing showing an operation sequence of the half cutting operation with respect to a printing tape having a tape width of "24 mm".
Figure 11C:
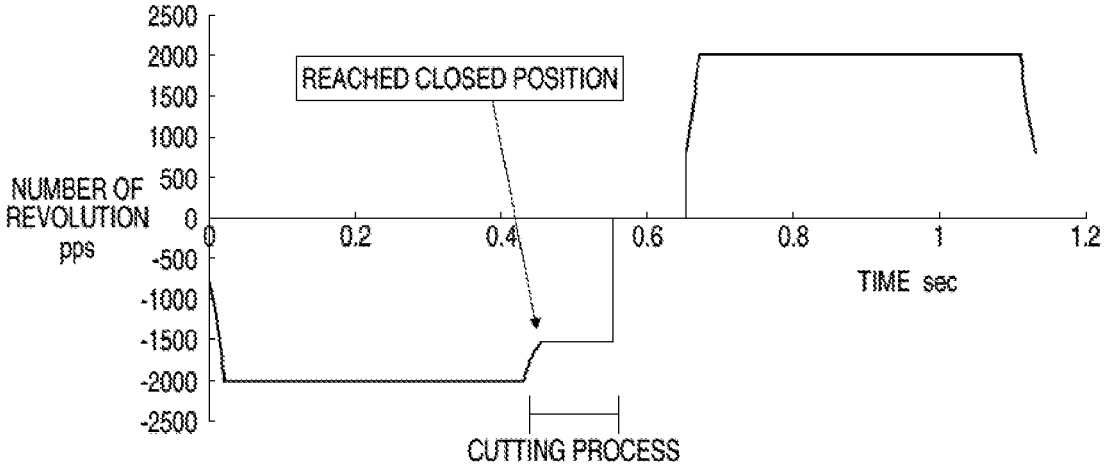
FIG. 11C is a drawing showing an operation sequence of the half cutting operation with respect to a printing tape having a tape width of "12 mm".

The half cutting which is an operation to cut the printing tape T by pressing in the width direction is associated with a large cutting load in comparison with the full cutting which is an operation to cut the printing tape T from one end thereof. In the case of the full cutting, the cutting load is gradually increased from the beginning of cutting to the end of cutting. In this embodiment, control of the half cutting operation and the full cutting operation is performed considering the difference in cutting load. Referring now to FIG. 9 to FIG. 11C, the half cutting operation and the full cutting operation will be described. FIG. 9 is a flowchart showing the full cutting operation. FIG. 10 is a flowchart showing the half cutting operation. FIGS. 11A to 11C are drawings showing an operation sequence of the full cutting operation and the half cutting operation. It is assumed that the tape width of the printing tape T is detected by the detecting unit 204 in advance, and the detected tape width is stored in the control unit 200 before the operation. It is also assumed that the cutter position is detected by the cutter position detecting sensor 77 to perform abnormality determination of the cutter position. Hereinafter, the position where the movable blade 82 is completely opened is referred to as "opened position" and the position where the movable blade 82 is completely closed is referred to as "closed position".

As shown in FIG. 9 and FIG. 11A, in the full cutting operation, the movable blade 82 is moved from the opened position to a position in the vicinity of the closed position at first. More specifically, the control unit 200 applies drive pulses of the normal rotation driving to the cutter motor 63, controls the number of revolutions to be accelerated to a predetermined number of revolutions for moving (for example, 2000 pps) (S1), and controls the rotation to be constant at the accelerated number of revolutions (S2). Then, the control unit 200 controls the number of revolutions of the cutter motor 63 to be kept at the constant speed by the number of steps required to move the movable blade 82 to a position in the vicinity of the closed position.

When the movable blade 82 is moved to the position in the vicinity of the closed position, the cutting process of the full cutting is performed. More specifically, the cycle of the drive pulses to be applied to the cutter motor 63 is modulated (modulating unit) to control the speed to be reduced (S3). Then, the control to reduce the speed (from 2000 pps to 800 pps) is continued until the movable blade 82 reaches the closed position, to cut the recording tape Ta and the release tape Tb of the printing tape T. In other words, the printing tape T is cut gradually while reducing the movement of the movable blade 82.

When the full cutting process is ended, the cutter motor 63 is stopped (S4). Then, after a predetermined time (for example, 0.1 seconds) has elapsed, the movable blade 82 is moved from the closed position to the opened position. More specifically, the control unit 200 applies drive pulses of the reverse rotation driving to the cutter motor 63, controls the number of revolutions to be accelerated to a predetermined number of revolutions for moving (for example, 2000 pps) (S5), and controls the rotation to be constant at the accelerated number of revolutions (S6). Then, when the number of steps and the constant-speed control are kept for a period required for moving the movable blade 82 to a position in the vicinity of the opened position, the control unit 200 controls the cutter motor 63 to be reduced in speed (S7) and stops the cutter motor 63 when the movable blade 82 is moved to the opened position (S8). With these steps, the full cutting operation is completed.

Referring now to FIG. 10 and FIGS. 11B and 11C, the half cutting operation will be described. Hereinafter, a position where the cutting blade 91 is opened completely is referred to as an opened position, a position where the cutting blade 91 is closed completely is referred to as a closed position, and a position where the cutting blade 91 comes into contact with the surface of the recording tape Ta is referred to as a cutting position. As shown in FIG. 10 and FIGS. 11B and 11C, in the half cutting operation, the cutting blade 91 is firstly moved from the opened position to a position in the vicinity of the cutting position. More specifically, the control unit 200 applies drive pulses of the reverse rotation driving to the cutter motor 63, controls the number of revolutions to be accelerated to a predetermined number of revolutions for moving (for example, 2000 pps) (S11), and controls the rotation to be constant at the accelerated number of revolutions (S12). Then, the control unit 200 controls the number of revolutions of the cutter motor 63 to be kept at the constant speed by the number of steps required to move the cutting blade 91 to a position in the vicinity of the cutting position.

When the cutting blade 91 is moved to a position in the vicinity of the cutting position, the cutting process of the half cutting is performed. The cutting process of the half cutting is performed by continuing the cutting operation until the cutter motor 63 as the stepping motor gets into the step-out state (until the cutter motor 63 loses steps) while modulating the cycle of the drive pulse and adjusting the step-out torque. In other words, by continuing the cutting operation, the cutting blade 91 comes into abutment with the printing tape T and the torque of the cutter motor 63 (the stepping motor) is gradually increased and, finally, reaches the step-out torque, thereby bringing the cutter motor 63 into the step-out state. When the stepping motor is brought into the step-out state, the torque is not increased any longer, and hence the torque is stabilized at the step-out torque as long as the cutting operation is continued. In contrast, the step-out torque is adjusted by the cycle of the drive pulse on the basis of the torque characteristic of the stepping motor. In other words, the torque of the stepping motor is controlled to a predetermined step-out torque adjusted in advance by continuing the cutting operation until the stepping motor is brought into the step-out state using the stepping motor. In this manner, the torque which serves as a cutting force can be controlled to a predetermined value only by controlling the stepping motor (cutter motor 63).

More specifically, the cutter motor 63 is controlled to be reduced in speed by modulating the cycle of the drive pulse (modulating unit) so that the number of revolutions of the cutter motor 63 becomes a predetermined number of revolutions until the cutting blade 91 is moved to the cutting position (S13). The predetermined number of revolutions is the number of revolutions according to the cutting load required for the cutting operation of the half cutter 62. The number of revolutions is also set according to the tape width detected by the detecting unit 204. In other words, since the cutting force (cutting load) required for the half cutting is different depending on the tape width of the printing tape T, the above-described number of revolutions is obtained by changing (modulating) the cycle of the drive pulse to be applied to the cutter motor 63 on the basis of the detected tape width to obtain the step-out torque according to the required cutting force. More specifically, when the tape width is "24 mm" (see FIG. 11B), the cycle is modulated so that the number of revolutions becomes 1000 pps, and when the tape width is "12 mm" (see FIG. 11C), the cycle is modulated so that the number of revolutions becomes 1500 pps. Furthermore, when the tape width is "6 mm" or "9 mm", the number of revolutions is set to 2000 pps, when the tape width is "12 mm" or "18 mm", the number of revolutions is set to 1500 pps, and when the tape width is "24 mm" or "36 mm", the number of revolutions is 1000 pps.

When the cutting blade 91 reaches the cutting position, the drive pulse is continuously applied until the cutter motor 63 reaches the step-out state, so that the cutting operation is continued (S14). Then, the step-out state is maintained by 100 steps of the drive pulse (S15). Accordingly, the half cutting of the printing tape T is performed, and the cutting process of the half cutting is ended.

When the cutting process is ended, the cutter motor 63 is stopped (S16). Then, after a predetermined time (for example, 0.1 seconds) has elapsed, the cutting blade 91 is moved from the closed position to the opened position. More specifically, the control unit 200 applies drive pulses of the normal rotation driving to the cutter motor 63, controls the number of revolutions to be accelerated to a predetermined number of revolutions for moving (for example, 2000 pps) (S17), and controls the rotation to be constant at the accelerated number of revolutions (S18). Then, when the number of steps and the constant-speed control are kept for a period required for moving the cutting blade 91 to a position in the vicinity of the opened position, the control unit 200 controls the cutter motor 63 to be reduced in speed (S19) and stops the cutter motor 63 when the cutting blade 91 is moved to the opened position (S20). With these steps, the half cutting operation is completed.

According to the configuration as described above, the torque corresponding to the cutting force is controlled to the predetermined value only by controlling the cutter motor 63, so that the control of the cutting force of the half cutter 62 can be performed with high degree of accuracy in a simple configuration.

The cutter motor 63 is continuously driven by the amount corresponding to 100 steps even after having lost steps, the sep-out state is maintained and hence the recording tape Ta or the release tape Tb can be cut reliably, whereby a clear half cutting is achieved.

In addition, the torque can be adjusted according to the cutting load by modulating (changing) the cycle of the drive pulse according to the type (tape width) of the printing tape T. Accordingly, the cutting operation can be performed easily and adequately without using the torque limiter or the like with respect to a plurality of types of the printing tape T having different cutting loads.

Also, by detecting the tape width as the type of the printing tape T by the tape identification sensor 37 and changing the cycle of the drive pulse according to the tape width, an adequate cutting operation may be performed on the printing tapes T having different widths.

Also, since the drive source (the stepping motor) may be shared by the half cutter 62 and the full cutter 61, the apparatus may be formed into a simple configuration as a whole. Since the torque control function can be applied to the full cutter 61, and hence the full cutting operation by the full cutter 61 can be performed stably with high degree of accuracy.

Furthermore, by modulating the cycle of the drive pulse of the stepping motor between the normal rotation which drives the full cutter 61 and the reverse rotation which drives the half cutter 62, the torque of the full cutter 61 at the time of being driven and the torque (step-out torque) of the half cutter 62 at the time of being driven may be differentiated. In other words, by modulating the cycle of the drive pulse according to the cutting load of the respective cutters, torque control from cutter to cutter may be realized. In this manner, the torque control from drive unit to drive unit can be performed simply and adequately without using the torque limiter, a complex power transmitting mechanism or the like.

In this embodiment, the step-out state is kept by an amount corresponding to 100 steps of the drive pulse applied to the cutter motor 63. However, the invention is not limited thereto as long as the step-out state is kept by an amount corresponding to n($10 \leq n \leq 5000$) steps. With reference to time, a configuration of maintaining the step-out state for t($0.1 \leq t \leq 2$) seconds is also applicable.

In the half cutting operation of this embodiment, as a configuration in which "continuing the cutting operation by the half cutter 62 until the cutter motor 63 loses steps", a configuration of "continuing the cutting operation until the fact that the cutter motor 63 has lost steps is detected" is also applicable. However, since the moving operation of the half cutter 62 from the start of the cutting operation to the end of the cutting operation and the number of steps of the cutter motor 63 for this moving operation are controlled with high degree of accuracy, the driving of the several steps in addition to the moving operation results into the step-out state. Considering this point, preferably, the detecting function is omitted and a configuration in which "the cutting operation is continued to a timing which seems to lose steps" or a configuration in which "the cutting operation is continued to at least the timing which seems to lose steps (including the error range) or beyond this timing" is employed.

Furthermore, in this embodiment, the torque control using the step-out torque is performed only at the time of cutting operation of the half cutting. However, a configuration in which the torque control is performed also in the cutting operation of the full cutting operation may be employed.

In this embodiment, a configuration in which only the recording tape Ta is cut as the half cutting is employed. However, a configuration in which only the release tape Tb is cut as the half cutting may be employed.

In this embodiment, the cycle of the drive pulse varies depending on the tape width of the printing tape T. However, the invention is not limited thereto as long as it is the type of the printing tape T (especially those which vary the cutting load by the difference thereof). For example, it may be the material of the printing tape T or the thickness of the tape or the like. Alternatively, a configuration in which the cycle of the drive pulse is varied depending on a plurality of elements (for example, the tape width and the material of the printing tape T) is also applicable.

In this embodiment, the drive pulse at the time of cutting operation of the half cutter 62 is varied depending on the type of the tape. However, a configuration in which the drive pulse at the time of the cutting operation of the full cutter 61 varies depending on the type of the tape is also applicable.

In this embodiment, the torque control using the step-out torque is performed in the cutting operation of the half cutting. However, the step-out torque does not necessarily have to be used as long as the half cutting is performed desirably. In other words, the torque control may be performed without using the step-out torque.

In this embodiment, the normal rotation of the cutter motor 63 is input to the full cutter 61 and the reverse rotation of the cutter motor 63 is input to the half cutter 62. However, on the contrary, a configuration in which the normal rotation of the cutter motor 63 is input to the half cutter 62 and the reverse rotation of the cutter motor 63 is input to the full cutter 61 is also applicable.

What is claimed is:

1. A tape cutting apparatus comprising:

a half cutter configured to cut a body tape or a release tape with respect to a processed tape having the release tape adhered to the body tape, for a plurality of types of processed tape, each of the plurality of types of processed tape having different cutting loads, the half cutter performing cutting for the plurality of types of processed tape individually;

a tape type detecting unit configured to detect the width, thickness, and type of at least the plurality of types of processed tape;

a stepping motor configured to cause the half cutter to perform a cutting operation; and a motor control unit configured to control the stepping motor, wherein the motor control unit includes a modulating unit configured to adjust a cutting load by varying a cycle of drive pulses to be applied to the stepping motor on a basis of a result of the detection of the width, thickness, and type of the processed tape by the tape type detecting unit, and the motor control unit is configured to continue controlling the stepping motor to cause the half cutter to contact the processed tape and then increase a cutting torque of the stepping motor until the cutting torque is stabilized at a step-out torque for the stepping motor, the step-out torque being maintained during the cutting operation.

2. The tape cutting apparatus according to claim 1, wherein the motor control unit maintains the step-out torque by an amount corresponding to $n(10 \leq n \leq 5000)$ steps of drive pulses to be applied to the stepping motor.

3. The tape cutting apparatus according to claim 1, wherein the motor control unit is configured to maintain the step-out torque for $t(0.1 \leq t \leq 2)$ seconds.

4. The tape cutting apparatus according to claim 1, further comprising a full cutter configured to be driven by an input of one of the normal rotation and the reverse rotation of the stepping motor to cut the processed tape wherein the half cutter is driven by an input of the other one of the normal and reverse rotations of the stepping motor, and the motor control unit includes a modulating unit configured to vary cycles of drive pulses in the normal rotation and the reverse rotation to be applied to the stepping motor respectively according to the loads of the full cutter and the load of the half cutter.

5. The tape cutting apparatus according to claim 4, further comprising:

a power transmitting unit having a first input unit configured to input one of the normal rotation and the reverse rotation of the stepping motor to the full cutter, and a second input unit configured to input the other one of the normal rotation and the reverse rotation of the stepping motor to the half cutter.

6. A tape printing apparatus comprising the tape cutting apparatus according to claim 1 and a printing unit configured to perform printing on the processed tape fed to the tape cutting apparatus.

7. A tape printing apparatus comprising the tape cutting apparatus according to claim 2 and a printing unit configured to perform printing on the processed tape fed to the tape cutting apparatus.

8. A tape printing apparatus comprising the tape cutting apparatus according to claim 3 and a printing unit configured to perform printing on the processed tape fed to the tape cutting apparatus.

9. A tape printing apparatus comprising the tape cutting apparatus according to claim 4 and a printing unit configured to perform printing on the processed tape fed to the tape cutting apparatus.

10. A tape printing apparatus comprising the tape cutting apparatus according to claim 5 and a printing unit configured to perform printing on the processed tape fed to the tape cutting apparatus.

11. A method of controlling a stepping motor constituting a power source of a half cutter configured to cut a body tape or a release tape of a processed tape having the body tape and the release tape adhered thereto, for a plurality of types of processed tape, each of the plurality of types of processed tape having different cutting loads, the half cutter performing cutting for the plurality of types of processed tape individually, comprising:

detecting the width, thickness, and type of a processed tape of at least the plurality of types of processed tape;

adjusting a cutting load by varying a cycle of drive pulses to be applied to the stepping motor on a basis of a result of the detection of the width, thickness, and type of the processed tape;

controlling a stepping motor to cause a half cutter to perform a cutting operation; and allowing the stepping motor to cause the half cutter to contact the processed tape, increasing, upon contacting the processed tape, a cutting torque of the stepping motor until the cutting torque is stabilized at a step-out torque for the stepping motor, the step-out torque being maintained during the cutting operation.

12. The method of controlling the stepping motor according to claim 11, further maintaining the step-out torque by an amount corresponding to $n(10 \leq n \leq 5000)$ steps of drive pulses to be applied to the stepping motor.

13. The method of controlling the stepping motor according to claim 11, further maintaining the step-out torque for $t(0.1 \leq t \leq 2)$ seconds.

14. The method of controlling the stepping motor according to claim 11, wherein the stepping motor constitutes a single power source for a full cutter configured to be driven by an input of one of normal rotation and the reverse rotation and to cut the processed tape and the half cutter configured to be driven by an input of the other one of the normal rotation and the reverse rotation, and the stepping motor is configured to vary cycles of drive pulses in the normal rotation and the reverse rotation to be applied to the stepping motor according to the loads of the full cutter and the load of the half cutter.

* * * * *